US006200945B1

(12) United States Patent
Lally et al.

(10) Patent No.: US 6,200,945 B1
(45) Date of Patent: Mar. 13, 2001

(54) ENVIRONMENTALLY SAFE SOLVENT COMPOSITION

(75) Inventors: Edward D. Lally, Long Beach; Richard J. Menke, Huntington Beach, both of CA (US)

(73) Assignee: McDonnell Douglas Corporation, St. Louis, MO (US)

( * ) Notice: Subject to any disclaimer, the term of this patent is extended or adjusted under 35 U.S.C. 154(b) by 0 days.

(21) Appl. No.: 09/315,763

(22) Filed: May 20, 1999

(51) Int. Cl.[7] ..... C11D 7/26; C11D 7/50

(52) U.S. Cl. ..... 510/365; 510/245; 510/253; 510/505; 134/2; 134/38; 134/40

(58) Field of Search ..... 510/201, 202, 510/245, 175, 176, 177, 178, 206, 256, 285, 319, 365, 405–416, 466, 506; 424/47–49, 52; 252/364, 67, 8, 194; 134/3, 26–29, 38–40

(56) References Cited

U.S. PATENT DOCUMENTS

| | | | | |
|---|---|---|---|---|
| 2,327,701 | | 8/1943 | Ellis et al. . | |
| 3,737,386 | | 6/1973 | Geiss et al. . | |
| 3,811,884 | | 5/1974 | Inoue et al. . | |
| 3,856,695 | | 12/1974 | Geiss et al. . | |
| 4,023,983 | | 5/1977 | Houke et al. . | |
| 4,301,224 | | 11/1981 | Kozima et al. . | |
| 4,309,300 | | 1/1982 | Danforth et al. . | |
| 4,395,287 | * | 7/1983 | Kobayashi et al. | 106/20 |
| 4,483,783 | | 11/1984 | Albanese . | |
| 4,762,703 | | 8/1988 | Abrutyn . | |
| 4,965,010 | | 10/1990 | Swett . | |
| 5,104,915 | | 4/1992 | Paci . | |
| 5,328,797 | * | 7/1994 | Neubauer et al. | 430/169 |
| 5,409,994 | | 4/1995 | Nakao et al. . | |
| 5,435,994 | * | 7/1995 | Valenty | 424/61 |
| 5,437,808 | | 8/1995 | Weltman et al. . | |
| 5,643,860 | | 7/1997 | Mella . | |
| 5,676,764 | | 10/1997 | Locklin et al. . | |
| 5,716,603 | * | 2/1998 | Chen et al. | 424/61 |
| 5,753,605 | * | 5/1998 | Blatter et al. | 510/299 |

FOREIGN PATENT DOCUMENTS

| | | |
|---|---|---|
| 12 57 319 | 12/1967 | (DE) . |
| 297 06 926 U | 7/1997 | (DE) . |
| 8-060531 | 3/1996 | (JP) . |
| 112187 | 6/1997 | (RO) . |

OTHER PUBLICATIONS

International Search Report for PCT/US00/06579, mailed Jul. 31, 2000, European Patent Office, A. Grittern.

*Alternative Cleaning Practices,* EPA/ICOLP Aircraft Maintenance Manual, pp. 71–188 and Appendix A1–F1.

* cited by examiner

*Primary Examiner*—Necholus Ogden
*Assistant Examiner*—Gregory E. Webb
(74) *Attorney, Agent, or Firm*—Alston & Bird LLP

(57) ABSTRACT

The present invention provides a solvent composition that is environmentally safe and has a palatable odor. The solvent composition can be used in numerous applications such as cleaning metal and non-metal surfaces and as a thinning agent. The solvent composition of the invention includes acetone, methyl propyl ketone, isopropyl alcohol, and n-butyl acetate; includes less than 3% methyl isobutyl ketone; and is substantially free of other undesirable chemicals such as methylene chloride, 1,1,1-trichloroethane, methyl ethyl ketone, and toluene. The present invention also includes a method of cleaning a metal or non-metal surface and thinning a composition using the solvent composition of the invention.

20 Claims, No Drawings

ENVIRONMENTALLY SAFE SOLVENT COMPOSITION

FIELD OF THE INVENTION

The present invention relates to solvent compositions and particularly to environmentally safe solvent compositions for cleaning metal and non-metal surfaces.

BACKGROUND OF THE INVENTION

In industry generally, there is a continuing need to produce compounds that are environmentally safe. The U.S. Environmental Protection Agency (EPA) is concerned with reducing the use of toxic chemicals that the EPA considers to be unsafe environmentally. In particular, in association with their 33/50 Program, the EPA has placed a high priority on reducing the presence of 17 toxic chemicals in the environment. These chemicals are published in a list ("the EPA 17 Toxics list") that includes benzene, cadmium and cadmium compounds, carbon tetrachloride, chloroform, chromium and chromium compounds, cyanides, lead and lead compounds, mercury and mercury compounds, methyl ethyl ketone, methyl isobutyl ketone, methylene chloride, nickel and nickel compounds, tetrachloroethylene, toluene, trichloroethylene, trichloroethane and xylenes.

One area where the use of environmentally safe compounds is important is the solvent industry. At one time, the preferred cleaning solvent for the aircraft and aerospace industry was methylene chloride. However, for environmental reasons, it has become less desirable for use in solvent compositions. One replacement for methylene chloride has been 1,1,1-trichloroethane (methyl chloroform). But, like methylene chloride, 1,1,1-trichloroethane is not considered environmentally safe. Moreover, 1,1,1-trichloroethane is not as effective a solvent as methylene chloride.

There has been a need in the art to provide new cleaning solvents that are not only effective but also environmentally safe. In the aircraft and aerospace industry recently, the solvents used to clean composites, metal aircraft parts and tooling include methyl ethyl ketone (MEK), toluene, methyl isobutyl ketone (MIBK), and combinations thereof. However, like methylene chloride and 1,1,1-trichloroethane, these compounds are not considered environmentally safe and have been listed on the EPA 17 Toxics list. In addition, the use of toluene must be reported under California law because of its reproductive toxicity. Therefore, there is a need in the art to produce solvent compositions with increased environmental safety that are effective at cleaning metal and non-metal surfaces.

SUMMARY OF THE INVENTION

The present invention provides a solvent composition that is environmentally safe and effective as a cleaning solvent. The solvent composition of the invention is substantially free of chemicals such as methylene chloride, 1,1,1-trichloroethene, MEK, and toluene that are on the EPA 17 Toxics list, includes less than 3% MIBK by volume. Thus the solvent composition is safer for the environment than conventional solvents. In addition to the environmental benefits of the solvent composition of the invention, the solvent composition has a more palatable odor than conventional solvent compositions. The solvent composition of the invention can also effectively be used for various types of metal and non-metal surfaces such as vehicular surfaces. Moreover, the solvent composition can be used in other applications such as a thinning agent for coatings, adhesives, sealants, primers, topcoats, and the like.

The solvent composition of the invention comprises a mixture of methyl propyl ketone (MPK), acetone, isopropyl alcohol and n-butyl acetate and has a calculated vapor pressure below 35 mm Hg at 20° C. Preferably, the vapor pressure is less than about 32 mm Hg at 20° C. (e.g. between about 30 and 32 mm Hg at 20° C.). In one preferred embodiment, the solvent composition includes about 30 to about 33 percent by volume acetone, about 47.5 to about 55 percent by volume methyl propyl ketone, about 10 to about 11 percent by volume isopropyl alcohol, and about 5 to about 6 percent by volume n-butyl acetate. More preferably, the solvent composition of the invention includes about 31 to about 32 percent by volume acetone, about 48.9 to about 53.5 percent by volume methyl propyl ketone, about 10 to about 11 percent by volume isopropyl alcohol, and about 5 to about 6 percent by volume n-butyl acetate. In one example in accordance with the invention, the solvent composition consists of about 31.6 percent by volume acetone, about 49.9 to about 52.6 percent by volume methyl propyl ketone, about 10.5 percent by volume isopropyl alcohol, and about 5.3 percent by volume n-butyl acetate.

In accordance with the invention, the solvent composition is substantially free of chemicals such as methylene chloride, 1,1,1-trichloroethane, MEK and toluene that are on the EPA 17 Toxics list and includes less than 3% MIBK by volume. In addition, the solvents used in the solvent composition of the invention are not listed among the 500 chemicals on the EPA Toxic Release Inventory List. The solvent composition of the invention can be used for cleaning metal and non-metal surfaces or as a thinning agent for coatings, adhesives, sealants, primers, topcoats, and the like.

The present invention also includes a method of cleaning a metal or non-metal surface that includes applying the solvent compositions described herein to a surface and removing the solvent from the surface. In particular, the solvent composition can be used as a cleaning solvent for vehicular surfaces such as for aircraft and automobiles. The present invention also further includes a method of thinning a composition by adding the solvent composition described herein to the composition to be thinned.

These and other features and advantages of the present invention will become more readily apparent to those skilled in the art upon consideration of the following detailed description, which describes both the preferred and alternative embodiments of the present invention.

DETAILED DESCRIPTION OF THE PREFERRED EMBODIMENTS

In the following detailed description, preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

The present invention provides a flammable, environmentally safe, solvent composition that includes acetone, methyl propyl ketone, isopropyl alcohol, and n-butyl acetate. Preferably, the solvent composition of the invention includes on a volume basis about 30 to about 33 percent acetone, about 47.5 to about 55 percent methyl propyl ketone, about 10 to about 11 percent isopropyl alcohol, and about 5 to about 6 percent n-butyl acetate. More preferably, the invention includes about 31 to about 32 percent acetone, about 48.9 to about 53.5 percent methyl propyl ketone, about 10 to about 11 percent isopropyl alcohol, and about 5 to about 6 percent n-butyl acetate. In one example, a solvent composition that has been found to be particularly useful as a cleaning solvent includes about 31.6 percent acetone, about 49.9 to about 52.6 percent methyl propyl ketone, about 10.5 percent isopropyl alcohol, and about 5.3 percent n-butyl acetate.

The solvent composition of the invention is substantially free (e.g. includes less than 1% by volume) of methylene chloride, 1,1,1-trichloroethane, methyl ethyl ketone, toluene, and other chemicals that are on the EPA 17 Toxics List. It is noted, however, that some commercially available methyl propyl ketone products can include 1–5% by volume of methyl isobutyl ketone as an impurity. Nevertheless, even if the MPK includes 5% MIBK by volume, the solvent composition still includes less than 3% MIBK by volume. This small MIBK impurity level is not considered to effect the solvent composition. Therefore, the solvent composition of the invention can be used in numerous applications and environments without potential environmental or health risks.

The solvent composition of the invention also has a low calculated vapor pressure. The South Coast Air Quality Management District (SCAQMD) and the Aerospace National Emissions Standard for Hazardous Air Pollutants (NESHAP) have determined that acetone is exempt and does not need to be considered in the calculation of vapor pressure. Therefore, acetone is not figured into the calculated vapor pressure herein. Specifically, the solvent composition of the invention has a calculated vapor pressure below 35 mm Hg at 20° C. and preferably less than about 32 mm Hg at 20° C., e.g., between about 30 mm Hg and about 32 mm Hg at 20° C. Therefore, the solvent composition of the invention meets the environmental requirements for cleaning solvents.

The solvent composition of the invention can be used to clean metal and non-metal surfaces and particularly the metal and non-metal surfaces of vehicles such as aircraft and automobiles. For example, the solvent composition can be used to clean composites, metal aircraft parts, tooling, paint spray guns, plated surfaces and painted or coated surfaces. In particular, the solvent composition has been shown to be as effective a cleaning solvent as conventional solvents without using chemicals on the EPA 17 Toxics list or chemicals having an unpleasant odor. The solvent composition can be used as a wiping solvent particularly to clean contamination and undesired coatings from surfaces prior to the application of organic coatings, adhesives, sealants, primers, topcoats, and the like. The solvent composition can also be used to clean surfaces prior to welding, painting or anodizing. Furthermore, the solvent composition can remove sealant materials (e.g. polysulfide and silicone sealants) as effectively as solvent compositions that include EPA 17 Toxics list components. The solvent can also be used on aircraft composition parts (e.g. epoxy resin/carbon fiber parts) and painted surfaces (e.g. epoxy and polyurethane). It can also be used on plastic surfaces depending on their solvent resistance.

The solvent composition can be applied to the surface to be cleaned by wiping, pouring or spraying the solvent composition onto the surface. For example, a cloth soaked with the solvent composition can be used to wipe the surface. The solvent composition is maintained on the surface for sufficient time to thoroughly clean the surface, e.g., about 1 to about 5 minutes. The solvent is then preferably removed from the surface such as by wiping the solvent away with a clean cloth thereby leaving a clean and dry surface. The solvent can also be removed by air drying because the solvent readily evaporates. Alternatively, the surface can be immersed in the solvent composition for sufficient time to clean the surface and the solvent removed from the surface to provide the clean surface.

The solvent compositions of the invention have demonstrated specific advantageous properties for use as cleaning solvents. For example, the solvent composition is non-corrosive to aluminum and will not remove cadmium plating when tested using American Society for Testing and Materials (ASTM) Method F483-90 "Standard Test Method for Total Immersion Corrosion Test for Aircraft Maintenance Chemicals." The solvent also leaves no residue when tested per ASTM F485-90 "Standard Test Method for Effects of Cleaners on Unpainted Aircraft Surfaces." The solvent has no negative effect (softening, blistering, dulling, etc.) on representative aircraft painted surfaces when tested per ASTM F502-83 "Standard Test Method for Effects of Cleaning and Chemical Maintenance Materials on Painted Aircraft Surfaces." In addition, the solvent will not cause hydrogen embrittlement of high strength steels when tested per ASTM F519-93 "Standard Test Method for Mechanical Hydrogen Embrittlement Testing of Plating Processes and Aircraft Maintenance Chemicals."

In addition to its use in cleaning, the solvent composition of the invention can also be used in other solvent applications. For example, the solvent composition can be used as a thinning agent for organic coatings, adhesives, sealants, primers, topcoats, and the like. Typically, a sufficient amount of the solvent composition is added to organic composition being thinned to provide a desired viscosity.

It is understood that upon reading the above description of the present invention, one skilled in the art could make changes and variations therefrom. These changes and variations are included in the spirit and scope of the following appended claims.

That which is claimed:

1. A solvent composition comprising a mixture of acetone, methyl propyl ketone, isopropyl alcohol and n-butyl acetate, said solvent composition having a calculated vapor pressure of less than 35 mm Hg at 20° C., wherein the vapor pressure of acetone is not figured into the calculated vapor pressure.

2. The solvent composition according to claim 1, comprising:

about 30 to about 33 percent by volume acetone;

about 47.5 to about 55 percent by volume methyl propyl ketone;

about 10 to about 11 percent by volume isopropyl alcohol; and about 5 to about 6 percent by volume n-butyl acetate.

3. The solvent composition according to claim 1 comprising:

about 31 to about 32 percent by volume acetone; and about 48.9 to about 53.5 percent by volume methyl propyl ketone.

4. The solvent composition of claim 1 including less than 3% by volume methyl isobutyl ketone and being substantially free of benzene, cadmium and cadmium compounds, carbon tetrachloride, chloroform, chromium and chromium compounds, cyanides, lead and lead compounds, mercury and mercury compounds, methyl ethyl ketone, methyl isobutyl ketone, methylene chloride, nickel and nickel compounds, tetrachloroethylene, toluene, trichloroethylene, trichloroethane and xylenes.

5. The solvent composition of claim 1, wherein the calculated vapor pressure is less than 32 mm Hg at 20° C.

6. A cleaning composition for cleaning a metal or non-metal surface comprising the solvent composition of claim 1.

7. A thinning agent comprising the solvent composition of claim 1.

8. A solvent composition consisting essentially of acetone, methyl propyl ketone, isopropyl alcohol and n-butyl acetate, said solvent composition having a calculated vapor pressure of less than 35 mm Hg at 20° C., wherein the vapor pressure of acetone is not figured into the calculated vapor pressure.

9. The solvent composition according to claim 8, consisting essentially of:

about 30 to about 33 percent by volume acetone;

about 47.5 to about 55 percent by volume methyl propyl ketone;

about 10 to about 11 percent by volume isopropyl alcohol; and about 5 to about 6 percent by volume n-butyl acetate.

10. The solvent composition according to claim 9, comprising:

about 31 to about 32 percent by volume acetone; and about 48.9 to about 53.5 percent by volume methyl propyl ketone.

11. The solvent composition according to claim 8, comprising less than 3% by volume methyl isobutyl ketone.

12. A flammable cleaning solvent consisting of:

about 31.6 percent by volume acetone;

about 49.9 to about 52.6 percent by volume methyl propyl ketone;

about 10.5 percent by volume isopropyl alcohol;

about 5.3 percent by volume n-butyl acetate; and less than about 2.7 percent by volume methyl isobutyl ketone.

13. A method of cleaning a metal or non-metal surface, comprising the steps of:

applying to a surface, a solvent composition comprising acetone, methyl propyl ketone, isopropyl alcohol and n-butyl acetate; said solvent composition having a calculated vapor pressure of less than 35 mm Hg at $_{20}$° C., wherein the vapor pressure of acetone is not figured into the calculated vapor pressure; and removing the solvent from the surface.

14. The method according to claim 13, wherein said applying step comprises applying a solvent composition that consists essentially of acetone, methyl propyl ketone, isopropyl alcohol and n-butyl acetate.

15. The method according to claim 13, wherein said applying step comprises applying a solvent composition comprising about 30 to about 33 percent by volume acetone, about 47.5 to about 55 percent by volume methyl propyl ketone, about 10 to about 11 percent by volume isopropyl alcohol, and about 5 to about 6 percent by volume n-butyl acetate.

16. The method according to claim 13, wherein said applying step comprises applying the solvent composition to a vehicular surface.

17. The method according to claim 13, wherein said applying step comprises applying a solvent composition that comprises about 31 to about 32 percent by volume acetone and about 48.9 to about 53.5 percent by volume methyl propyl ketone.

18. The method according to claim 13, wherein said applying step comprises applying a solvent composition that includes less than 3% by volume methyl isobutyl ketone and that is substantially free of benzene, cadmium and cadmium compounds, carbon tetrachloride, chloroform, chromium and chromium compounds, cyanides, lead and lead compounds, mercury and mercury compounds, methyl ethyl ketone, methyl isobutyl ketone, methylene chloride, nickel and nickel compounds, tetrachloroethylene, toluene, trichloroethylene, trichloroethane and xylenes.

19. A method of thinning a composition comprising the step of adding to the composition, a thinning composition comprising acetone, methyl propyl ketone, isopropyl alcohol, and n-butyl acetate, said thinning composition having a calculated vapor pressure of less than 35 mm Hg at 20° C.

20. The method according to claim 19, wherein said thinning step comprises adding a thinning composition that includes less than 3% by volume methyl isobutyl ketone and that is substantially free of benzene, cadmium and cadmium compounds, carbon tetrachloride, chloroform, chromium and chromium compounds, cyanides, lead and lead compounds, mercury and mercury compounds, methyl ethyl ketone, methyl isobutyl ketone, methylene chloride, nickel and nickel compounds, tetrachloroethylene, toluene, trichloroethylene, trichloroethane and xylenes.

* * * * *